US009906865B2

(12) United States Patent
Yang et al.

(10) Patent No.: US 9,906,865 B2
(45) Date of Patent: Feb. 27, 2018

(54) PIEZOELECTRIC LOUDSPEAKER

(71) Applicants: Su-Pei Yang, Taipei (TW); Ing-Ming Lai, Taipei (TW)

(72) Inventors: Su-Pei Yang, Taipei (TW); Ing-Ming Lai, Taipei (TW)

( * ) Notice: Subject to any disclaimer, the term of this patent is extended or adjusted under 35 U.S.C. 154(b) by 0 days.

(21) Appl. No.: 15/156,298

(22) Filed: May 16, 2016

(65) Prior Publication Data

US 2016/0366519 A1 Dec. 15, 2016

(30) Foreign Application Priority Data

Jun. 12, 2015 (TW) ..... 104209449 U

(51) Int. Cl.

| | |
|---|---|
| ***H04R 7/26*** | (2006.01) |
| ***H04R 17/00*** | (2006.01) |
| ***H04R 31/00*** | (2006.01) |
| ***H04R 7/04*** | (2006.01) |

(52) U.S. Cl.

CPC ..... *H04R 7/26* (2013.01); *H04R 7/045* (2013.01); *H04R 17/00* (2013.01); *H04R 31/006* (2013.01)

(58) Field of Classification Search

CPC ..... H04R 7/26; H04R 7/045; H04R 17/00; H04R 17/005; H04R 17/025; H01L 41/00; H01L 41/0805

See application file for complete search history.

(56) References Cited

U.S. PATENT DOCUMENTS

| | | | | |
|---|---|---|---|---|
| 8,053,954 | B2 | 11/2011 | Yang et al. | |
| 9,444,155 | B2 * | 9/2016 | Chen | H01R 4/48 |
| 9,570,817 | B1 * | 2/2017 | Wang | H01R 4/4818 |
| 2004/0218779 | A1 * | 11/2004 | Fukuyama | H04R 1/06 381/409 |
| 2007/0263886 | A1 * | 11/2007 | Starnes | H04R 17/10 381/190 |
| 2008/0037819 | A1 * | 2/2008 | Yang | H04R 17/00 381/395 |

* cited by examiner

*Primary Examiner* — Angelica M McKinney

(74) *Attorney, Agent, or Firm* — Pai Patent & Trademark Law Firm; Chao-Chang David Pai

(57) ABSTRACT

A piezoelectric loudspeaker includes an oscillator, two damping members and a plurality of terminals which are disposed in a loudspeaker box. The oscillator includes a plate and two piezoelectric members coupled to two sides of the plate. The oscillator is disposed in an accommodation trough of the loudspeaker box, and has a fixed end and a free end. The damping members are made of silicone and disposed in the accommodation trough. The damping members are pressed against an edge of the free end of the plate of the oscillator. The terminals are connected with the plate and the piezoelectric members of the oscillator, respectively. Through the damping members, the present invention provides a better shock absorption effect to effectively reduce the noises caused by the free end of the oscillator and to effectively enhance the tone.

9 Claims, 8 Drawing Sheets

PIEZOELECTRIC LOUDSPEAKER

BACKGROUND OF THE INVENTION (a) Field of the Invention

The present invention relates to a piezoelectric loudspeaker, and more particularly to an ultra-thin structure of a piezoelectric loudspeaker.

(b) Description of the Prior Art

A piezoelectric loudspeaker is also called a ceramic loudspeaker, and comprises an oscillator composed of a metal sheet and multiple layers of piezoelectric ceramic sheets. Alternating voltage is inputted to the oscillator, such that the oscillator can curve and oscillate. Longitudinal vibrator type, dual-state type, piezoelectric polymer type, and many other types of piezoelectric loudspeakers are known to have thin and small-sized characteristics.

The oscillator of a conventional piezoelectric loudspeaker is quite thin and usually applied to mobile phones or tablet personal computers. The flaky oscillator is connected with an essential electrical wire or signal line by welding, and then the oscillator is adhered to the circuit board of a mobile phone. The assembly and welding procedure are complicated, and the quality of weld will have a great effect on the sound produced. The inventor of the present invention has invented a piezoelectric loudspeaker as disclosed in U.S. Pat. No. 8,053,954 to overcome the aforesaid problems.

The piezoelectric oscillator as disclosed in U.S. Pat. No. 8,053,954 is composed of two sheets. A shock absorption member is provided at the middle of the oscillator close to a fixed end thereof. However, the amplitude of oscillation of a free end of the oscillator, opposite the fixed end, may be so large that the piezoelectric loudspeaker may have noises to influence the quality of the sound. Accordingly, the inventor of the present invention has devoted himself with his many years of practical experiences to solve these problems.

SUMMARY OF THE INVENTION

The primary object of the present invention is to provide a piezoelectric loudspeaker that has a structure to reduce noises. Through damping members disposed in the piezoelectric loudspeaker and the assembled structure of the damping members and an oscillator and a loudspeaker box, it is easy to install the damping members and the noises can be reduced effectively.

In order to achieve the aforesaid object, the piezoelectric loudspeaker of the present invention comprises a loudspeaker box, an oscillator, two damping members, and a plurality of terminals. The loudspeaker box comprises a main body and a cover. The main body has an accommodation trough at one side thereof, at least one positioning portion located at a first end of the accommodation trough, and a first retaining trough located at a second end of the accommodation trough. The cover has a second retaining trough. The cover is adapted to cover the accommodation trough of the main body. An oscillator is disposed in the accommodation trough of the main body of the loudspeaker box. The oscillator comprises a plate and two piezoelectric members coupled to two sides of the plate. The plate has a fixed end coupled to the positioning portion at the first end of the accommodation trough and a free end extending toward the first retaining trough at the second end of the accommodation trough. The two damping members are made of silicone and disposed in the first retaining trough of the loudspeaker box and the second retaining trough of the cover, respectively. The two damping members are pressed against an edge of the free end of the plate of the oscillator. The plurality of terminals are disposed in the accommodation trough of the main body of the loudspeaker box and electrically connected with the oscillator.

Through the damping members made of silicone, the present invention provides a better shock absorption effect to effectively reduce the noises caused by the free end of the oscillator and to effectively enhance the tone.

DETAILED DESCRIPTION OF THE PREFERRED EMBODIMENTS

Embodiments of the present invention will now be described, by way of example only, with reference to the accompanying drawings.

Figure 1:
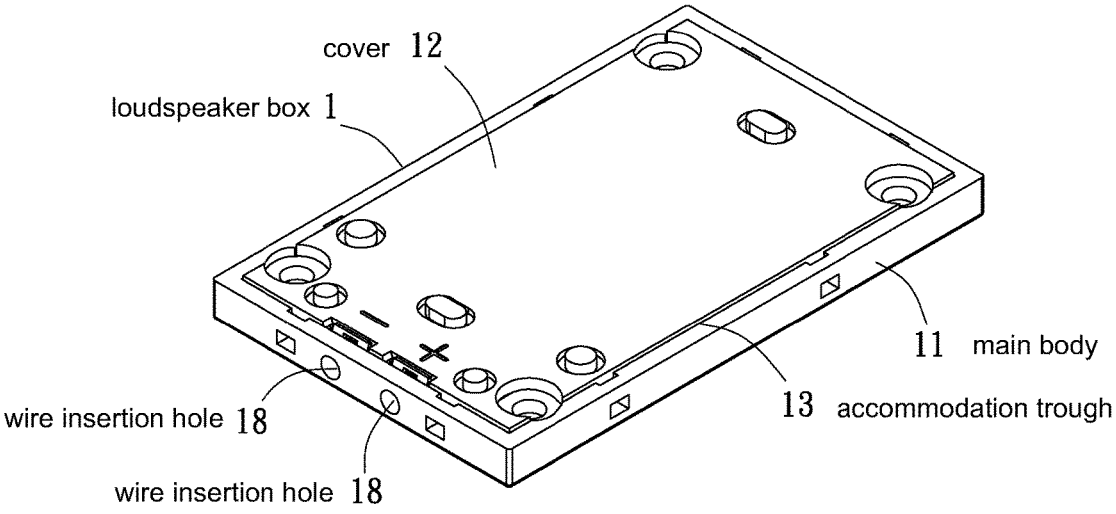
FIG. 1 is a perspective view of the piezoelectric loudspeaker of the present invention.
Figure 2:
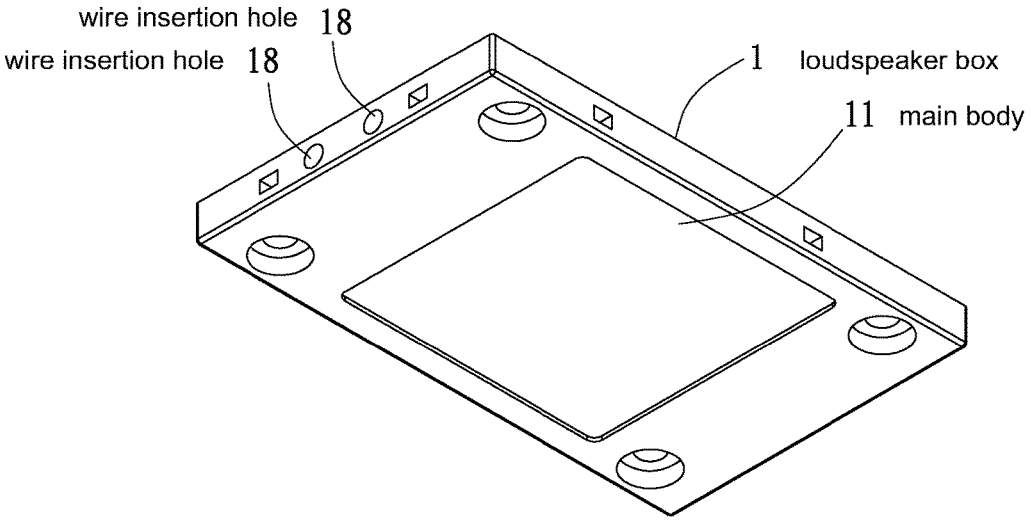
FIG. 2 is another perspective view of the piezoelectric loudspeaker of the present invention.
Figure 3:
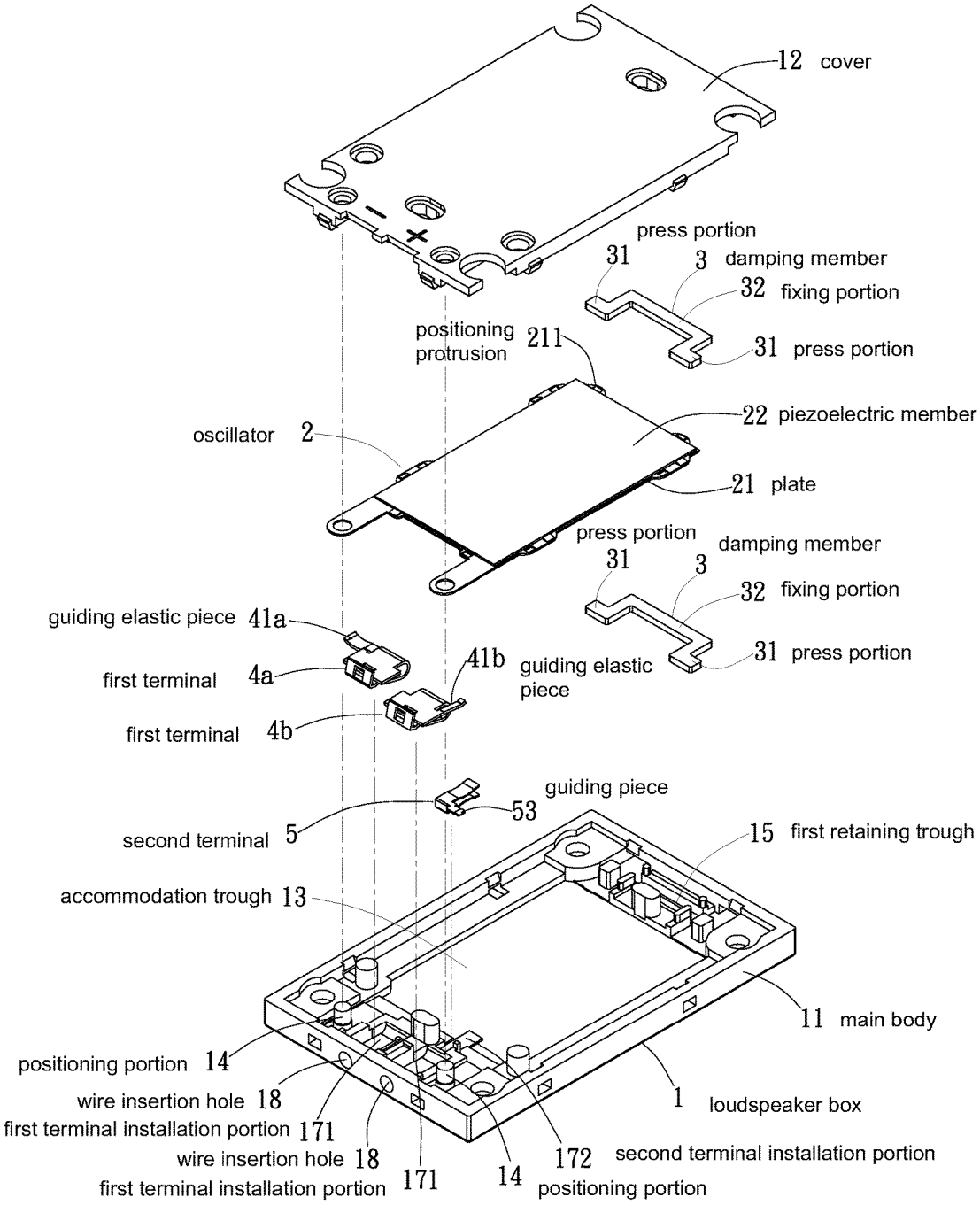
FIG. 3 is an exploded view of the piezoelectric loudspeaker of the present invention.
Figure 4:
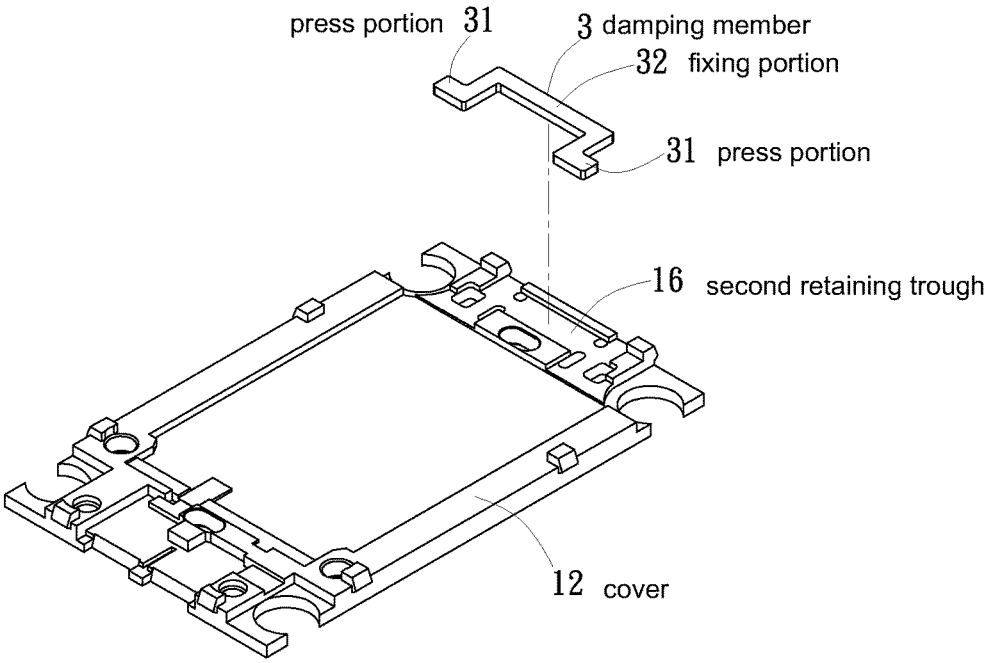
FIG. 4 is a perspective view of the cover of the present invention.
Figure 5:
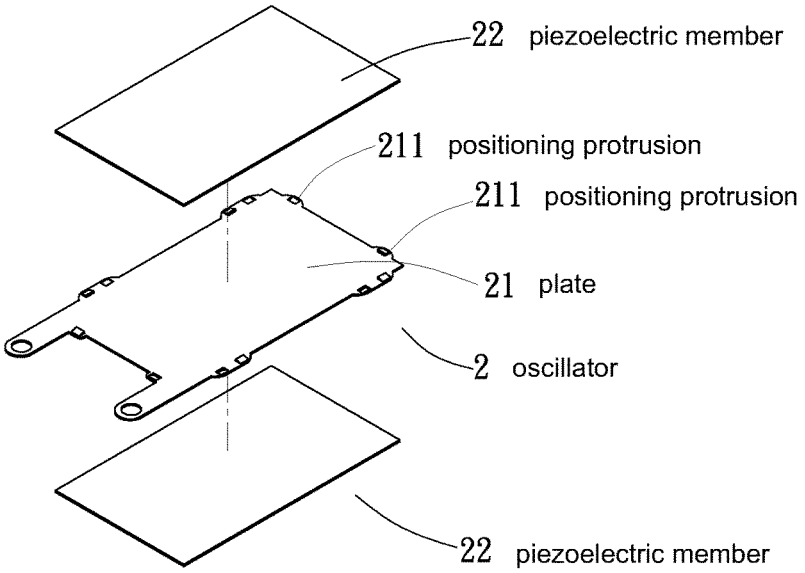
FIG. 5 is an exploded view of the oscillator of the present invention.
Figure 6:
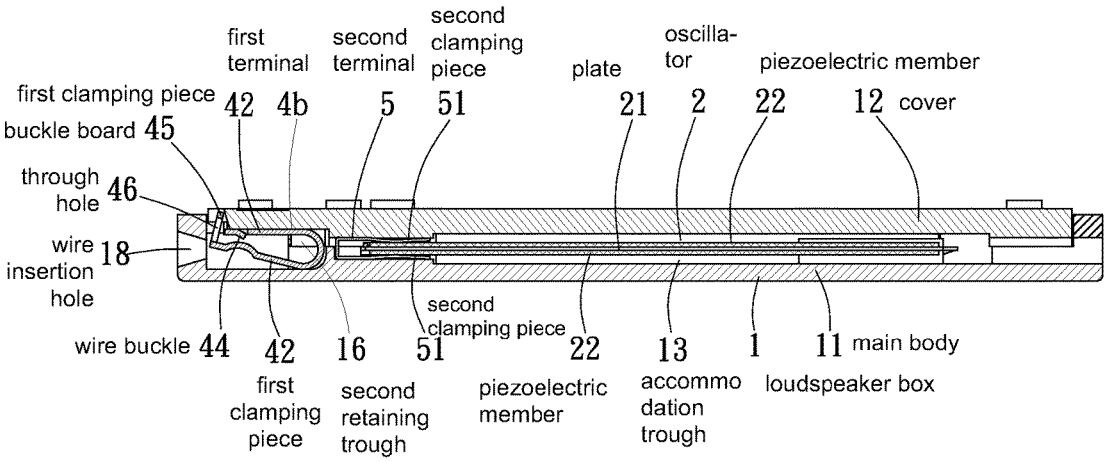
FIG. 6 is a sectional view of the piezoelectric loudspeaker of the present invention.
Figure 7:
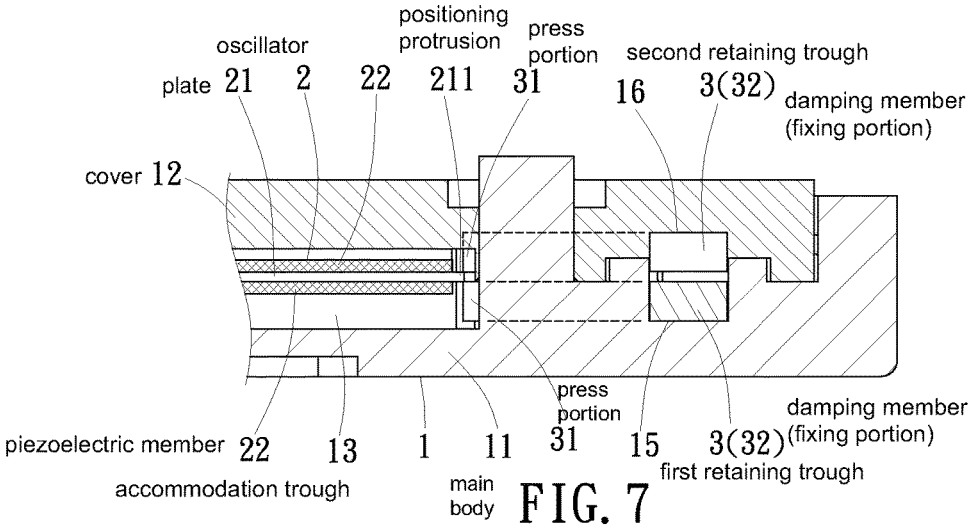
FIG. 7 is a partial enlarged view of the piezoelectric loudspeaker of the present invention.
Figure 8:
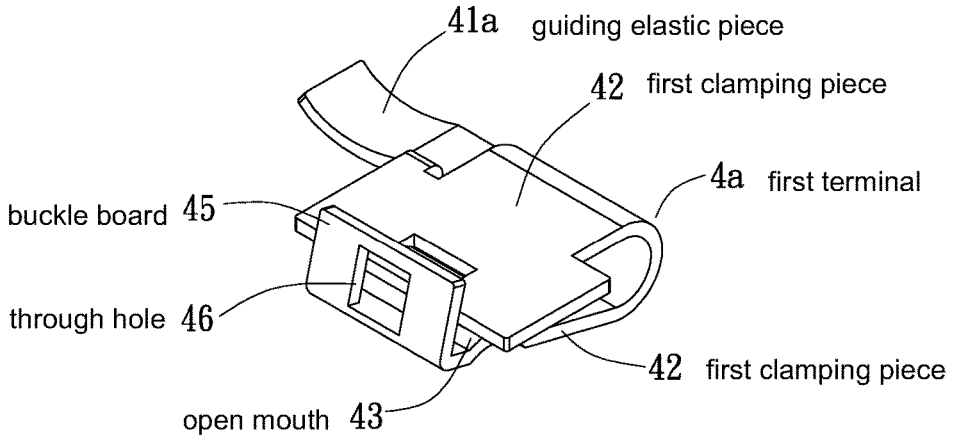
FIG. 8 is a perspective view of the first terminal of the present invention.

As shown in FIG. 1, FIG. 2 and FIG. 3, a piezoelectric loudspeaker according to a preferred embodiment of the present invention comprises a loudspeaker box 1, an oscillator 2, two damping members 3, and a plurality of terminals 4*a*, 4*b*, 5. The loudspeaker box 1 comprises a rectangular main body 11 and a cover 12. The main body 11 has an accommodation trough 13 at one side thereof, at least one positioning portion 14 located at a first end of the accommodation trough 13, and a first retaining trough 15 located at a second end of the accommodation trough 13. The cover 12 has a second retaining trough 16, as shown in FIG. 4. When the cover 12 covers the accommodation trough 13 of the loudspeaker box 11, the retaining trough 16 corresponds to the first retaining trough 15. The oscillator 2 is disposed in the accommodation trough 13 of the main body 11 of the loudspeaker box 1. The oscillator 2 comprises a plate 21 and piezoelectric members 22 coupled to two sides of the plate 21, as shown in FIG. 5. A circumferential portion of the plate 21 has a plurality of positioning protrusions 211. The plate 21 has a fixed end coupled to the positioning portion 14 at the first end of the accommodation trough 13 and an opposing free end extending toward the first retaining trough 15 at the second end of the accommodation trough 13, such that the oscillator 2 is suspended in the accommodation trough 13, as shown in FIG. 6. The piezoelectric members 22 can be ceramic piezoelectric sheets, which are coupled to the two sides of the plate 21 and limited by the positioning protrusions 211. The two damping members 3 are made of silicone and disposed in the first retaining trough 15 of the loudspeaker box 1 (as shown in FIG. 3) and the second retaining trough 16 of the cover 12 (as shown in FIG. 4), respectively. The two damping members 3 are pressed against the positioning protrusions 211 at the free end of the plate 21 of the oscillator 2, as shown in FIG. 7. The terminals 4*a*, 4*b*, 5 are disposed in the accommodation trough 13 of the main body 11 of the loudspeaker box 1, and are electrically connected with the plate 21 and the piezoelectric members 22 of the oscillator 2. For the piezoelectric loudspeaker of the present invention, there is no need to use double-sided adhesive tape or a fixing member for installing the damping members 3. It is easy to install the damping members. Through the damping members 3 made of silicone, the present invention provides a better shock absorption effect to effectively reduce the noises caused by the free end of the oscillator 2 and to effectively enhance the tone.

As shown in FIG. 3 and FIG. 4, each damping member 3 of the present invention is preferably made of silicone, and comprises two press portions 31 and a fixing portion 32 connected between the two press portions 31. The two press portions 31 are integrally formed with the fixing portion 32. The press portions 31 each have a rectangular shape and are adapted to press the positioning protrusions 211 at the free end of the plate 21 of the oscillator 2, as shown in FIG. 7. The fixing portion 32 has a reverse U shape or other shape, with two ends connected to the press portions 31. The fixing portion 32 is retained in the first retaining trough 15 and the second retaining trough 16 to prevent it from moving. The first retaining trough 15 of the main body 11 and the second retaining trough 16 of the cover 12 each have a reverse U shape corresponding to the fixing portion 32. The reverse U-shaped fixing portions 32 of the damping members 3 are respectively disposed in the reverse U-shaped troughs, which are assembled and positioned quickly to avoid sliding.

Figure 9:
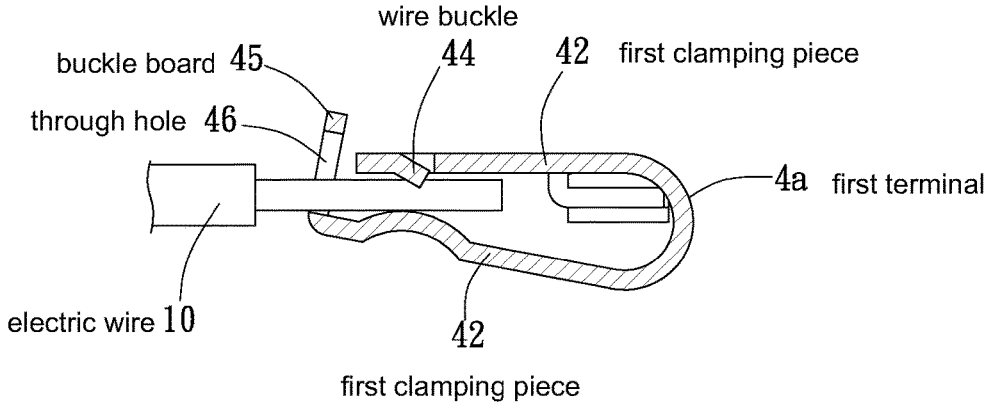
FIG. 9 is a sectional view of the first terminal of the present invention when in use.
Figure 10:
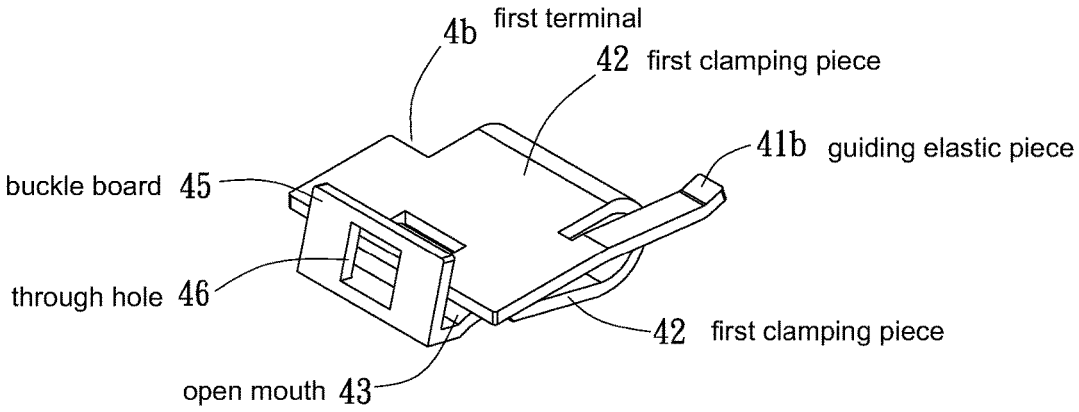
FIG. 10 is a perspective view of another first terminal of the present invention.
Figure 11:
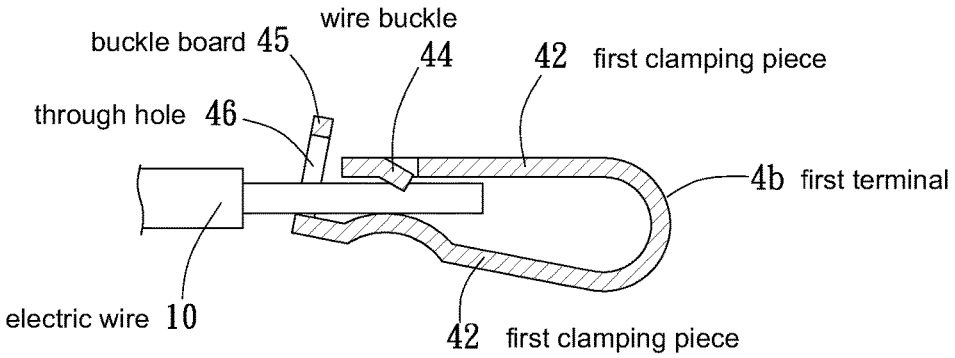
FIG. 11 is a sectional view of another first terminal of the present invention when in use.

As shown in FIG. 3, the terminals of the present invention comprise two first terminals 4*a*, 4*b* for quickly connecting with an electric wire and electrically connecting with guiding members of the oscillator 2. The first terminals 4*a*, 4*b* are disposed on first terminal installation portions 171 of the main body 11, respectively. Each of the first terminals 4*a*, 4*b* is formed with a guiding elastic piece 41*a*, 41*b*. The guiding elastic piece 41*a* of the first terminal 4*a* is in contact with the plate 21 of the oscillator 2. The guiding elastic piece 41*b* of the first terminal 4*b* is in contact with a second terminal 5. Through the second terminal 5, the first terminals are connected with the piezoelectric members 22. Specifically, as shown in FIG. 8, FIG. 9, FIG. 10, and FIG. 11, each of the first terminals 4*a*, 4*b* is bent to form a ⊏-like shape having two first clamping pieces 42 and an open mouth 43. Namely, the two first clamping pieces 42 are connected to each other at one end thereof and the open mouth 43 is formed between the two first clamping pieces 42 at an opposite end thereof. One side of one of the two first clamping pieces 42 is formed with the guiding elastic piece 41*a*, 41*b*. One of the two first clamping pieces 42 of each of the first terminals 4*a*, 4*b* has a wire buckle 44 which obliquely protrudes toward the other of the two first clamping pieces 42. The wire buckle 44 is adapted to buckle an electric wire 10 inserted through the open mouth 43. Furthermore, the other of the two first clamping pieces 42 of each of the first terminals 4*a*, 4*b* is provided with a buckle board 45 at the open mouth 43. The buckle board 45 has a through hole 46 for the electric wire 10 to be inserted between the two first clamping pieces 42. The through hole 46 corresponds to a wire insertion hole 18 of the main body 11, as shown in FIG. 6. After the external electric wire 10 is inserted into the through hole 46, as shown in FIG. 9 and FIG. 11, the electric wire 10 is clamped by the first clamping pieces 42 and the buckle board 45, providing a quick electrical connection.

Figure 12:
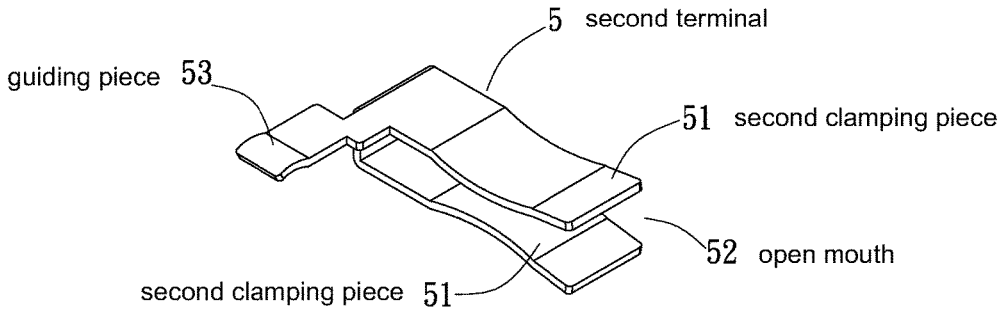
FIG. 12 is a perspective view of the second terminal of the present invention.
Figure 13:
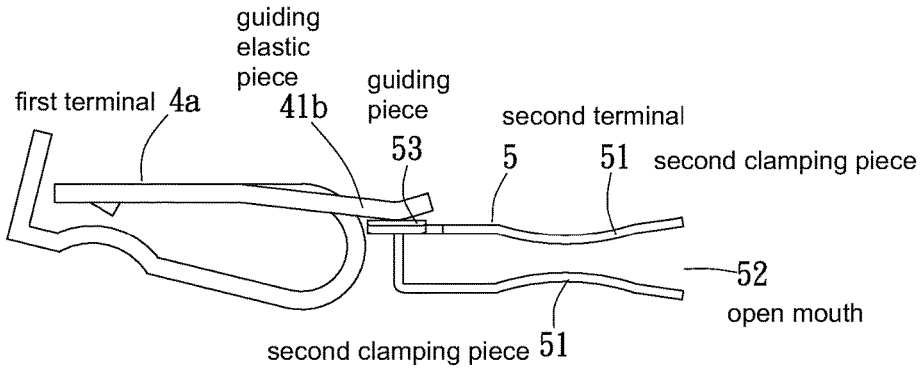
FIG. 13 is a sectional view of the second terminal of the present invention when in use.

As shown in FIG. 3, the main body 11 of the present invention comprises a second terminal installation portion 172 for the second terminal 5 to be installed thereon. The second terminal 5 is in contact with the piezoelectric members 22 at two sides of the plate 21 of the oscillator 2. The guiding electric piece 41*b* of the first terminal 4*b* is in contact with the second terminal 5. Specifically, as shown in FIG. 12 and FIG. 13, the second terminal 5 is bent to form a ⊏-like shape having two second clamping pieces 51 and an open mouth 52. Namely, the two second clamping pieces 51 are connected to each other at one end thereof and the open mouth 52 is formed between the two second clamping pieces 51 at an opposite end thereof. One of the two second clamping pieces 51 is in contact with one of the two piezoelectric members 22 of the oscillator 2, and the other of the two second clamping pieces 51 is in contact with the other of the two piezoelectric members 22 of the oscillator 2. One of the two second clamping pieces 51 is formed with a guiding piece 53. The guiding elastic piece 41*b* of the first terminal 4*b* is in contact with the guiding piece 53 of the second terminal 5.

Figure 14:
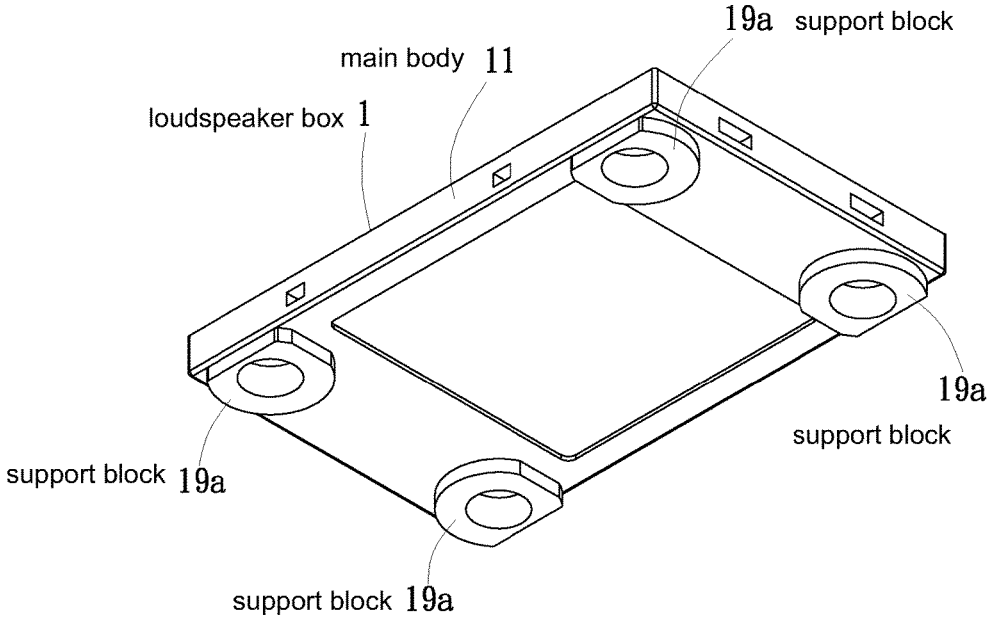
FIG. 14 is a perspective view of another embodiment of the loudspeaker box of the present invention.
Figure 15:
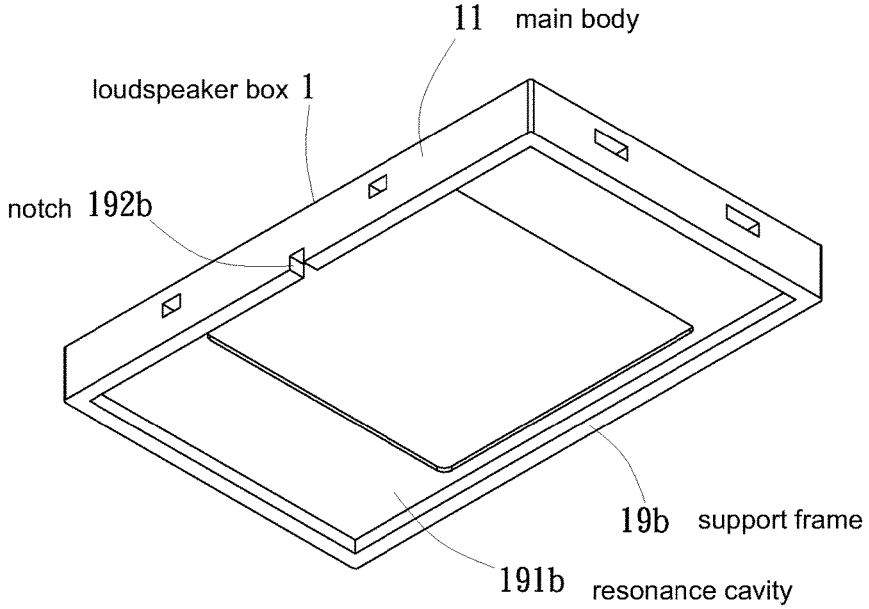
FIG. 15 is a perspective view of a further embodiment of the loudspeaker box of the present invention.

As shown in FIG. 14, an outer surface of the main body 11 or the cover 12 of the loudspeaker box 1 is provided with a plurality of support blocks 19*a*. When the loudspeaker box 1 is installed on a circuit board, the support blocks 19*a* are adapted to support the loudspeaker box 1. As shown in FIG. 15, the periphery of the main body 11 or the cover 12 of the loudspeaker box 1 is provided with a support frame 19*b* to form a resonance cavity 191*b* encircled by the support frame 19*b*. One side of the support frame 19*b* has a notch 192*b* in communication with the resonance cavity 191*b*. When the loudspeaker box 1 is installed on a circuit board, the support frame 19*b* is adapted to support the loudspeaker box 1 so that the resonance cavity 191*b* is located between the loudspeaker and the circuit board to provide a better resonance effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A piezoelectric loudspeaker, comprising:

a loudspeaker box comprising a main body and a cover, the main body having an accommodation trough at one side thereof, at least one positioning portion located at a first end of the accommodation trough, and a first retaining trough located at a second end of the accommodation trough; the cover having a second retaining trough, the cover being adapted to cover the accommodation trough of the main body;

an oscillator disposed in the accommodation trough of the main body of the loudspeaker box, the oscillator comprising a plate and two piezoelectric members coupled to two sides of the plate, the plate having a fixed end coupled to the positioning portion at the first end of the accommodation trough and a free end extending toward the first retaining trough at the second end of the accommodation trough;

two damping members made of silicone, the two damping members being respectively disposed in the first retaining trough of the loudspeaker box and the second retaining trough of the cover; and a plurality of terminals disposed in the accommodation trough of the main body of the loudspeaker box and electrically connected with the oscillator, wherein each of the damping members comprises two press portions and a fixing portion connected between the two press portions, the two press portions being respectively pressed against two positioning protrusions at the free end of the plate of the oscillator; and the first retaining trough and the second retaining trough correspond in shape to the fixing portion;

wherein the press portions each have a rectangular shape, the fixing portion has a reverse U shape with two ends connected to the press portions, and the first retaining trough and the second retaining trough each have a reverse U shape corresponding to the fixing portion.

2. The piezoelectric loudspeaker as claimed in claim 1, wherein the main body of the loudspeaker box has two positioning portions located at the first end of the accommodation trough, two first terminal installation portions corresponding to the two positioning portions, and a second terminal installation portion corresponding to one of the two first terminal installation portions; the fixed end of the plate of the oscillator is coupled to the two positioning portions in the accommodation trough; and the plurality of terminals are disposed in the first terminal installations and the second terminal installation portion, respectively.

3. The piezoelectric loudspeaker as claimed in claim 2, wherein the plurality of terminals comprise two first terminals and a second terminal, the first terminals are respectively disposed on the first terminal installation portions of the main body, each of the two first terminals is formed with a guiding elastic piece, the guiding elastic piece of one of the two first terminals is in contact with the plate of the oscillator, the second terminal is disposed on the second terminal installation portion of the main body and in contact with the piezoelectric members at the two sides of the plate of the oscillator, and the guiding electric piece of the other of the two first terminals is in contact with the second terminal.

4. The piezoelectric loudspeaker as claimed in claim 3, wherein each of the two first terminals is bent into a shape having two first clamping pieces connected to each other at one end and an open mouth between the two first clamping pieces at an opposite end, and one side of one of the two first clamping pieces is formed with the guiding elastic piece.

5. The piezoelectric loudspeaker as claimed in claim 4, wherein one of the two first clamping pieces of each of the first terminals has a wire buckle which obliquely protrudes toward the other of the two first clamping pieces.

6. The piezoelectric loudspeaker as claimed in claim 5, wherein the other of the two first clamping pieces of each of the first terminals is provided with a buckle board at the open mouth, and the buckle board has a through hole for an external electric wire to be inserted between the two first clamping pieces.

7. The piezoelectric loudspeaker as claimed in claim 3, wherein the second terminal is bent into a shape having two second clamping pieces connected to each other at one end and an open mouth between the two second clamping pieces at an opposite end, one of the two second clamping pieces is in contact with one of the two piezoelectric members of the oscillator, and the other of the two second clamping pieces is in contact with the other of the two piezoelectric members of the oscillator.

8. The piezoelectric loudspeaker as claimed in claim 1, wherein an outer surface of the main body or the cover of the loudspeaker box is provided with a plurality of support blocks.

9. The piezoelectric loudspeaker as claimed in claim 1, wherein a periphery of the main body or the cover of the loudspeaker box is provided with a support frame to form a resonance cavity encircled by the support frame, and one side of the support frame has a notch in communication with the resonance cavity.

* * * * *